US006349863B1

(12) United States Patent
Frye

(10) Patent No.: US 6,349,863 B1
(45) Date of Patent: Feb. 26, 2002

(54) GARMENT DISPLAY ASSEMBLY

(76) Inventor: Betty F. Frye, 3245 Mull Creek La., Claremont, NC (US) 28610

( * ) Notice: Subject to any disclaimer, the term of this patent is extended or adjusted under 35 U.S.C. 154(b) by 0 days.

(21) Appl. No.: 09/774,766

(22) Filed: Feb. 1, 2001

(51) Int. Cl.[7] ..... A47G 25/14
(52) U.S. Cl. ..... 223/85
(58) Field of Search ..... 223/85, 87, 88, 223/92, 95

(56) References Cited

U.S. PATENT DOCUMENTS

| | | | | |
|---|---|---|---|---|
| D91,319 | S | | 1/1934 | Falk |
| 2,058,217 | A | | 10/1936 | Dixon |
| 2,191,714 | A | | 2/1940 | Gustin |
| 2,192,167 | A | | 3/1940 | Bagley et al. |
| 2,451,552 | A | | 10/1948 | Hayward |
| 2,498,400 | A | | 2/1950 | Du Lude |
| 2,594,966 | A | | 4/1952 | McKinney |
| 2,598,315 | A | | 5/1952 | Sweet |
| 2,822,967 | A | | 2/1958 | Spitz |
| 3,651,999 | A | | 3/1972 | Fiocca |
| 3,746,222 | A | * | 7/1973 | Tiss ..... 223/87 |
| 3,945,500 | A | | 3/1976 | Meckstroth |
| 4,366,909 | A | | 1/1983 | Fahmi |
| 5,014,957 | A | | 5/1991 | Nichol, Jr. |
| 5,027,945 | A | * | 7/1991 | Wilkins ..... 206/278 |
| 5,127,559 | A | * | 7/1992 | Freer et al. ..... 223/85 |
| 5,161,720 | A | * | 11/1992 | Kolton ..... 223/85 |
| 4,474,316 | A | * | 10/1994 | Philibert ..... 223/88 |
| 5,857,597 | A | * | 6/1998 | Kolton ..... 223/1 |
| 6,006,964 | A | | 12/1999 | White |
| 6,170,679 | B1 | | 1/2001 | Frye et al. |

OTHER PUBLICATIONS

Conover Plastics, Inc. Brochure (Undated 2 pages).

* cited by examiner

*Primary Examiner*—Bibhu Mohanty

(57) ABSTRACT

A garment display assembly is provided for distribution and retail sales of socks or other garments which allows an uncluttered view of the product. Assembly is simple and inexpensive by use of a molded plastic hanger and a printed cardboard display panel with the socks being "tacked" thereto. The integrity of the display assembly is maintained through shipping and repeated handling by customers.

14 Claims, 2 Drawing Sheets

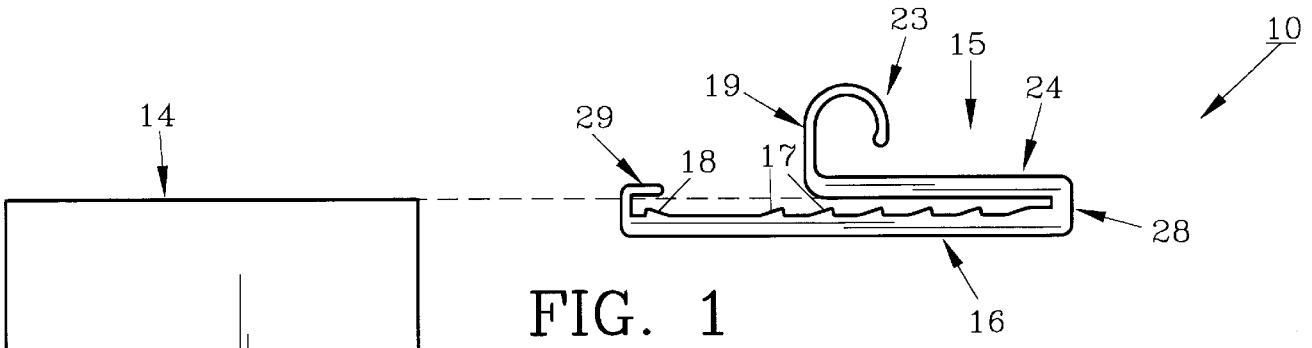
FIG. 1
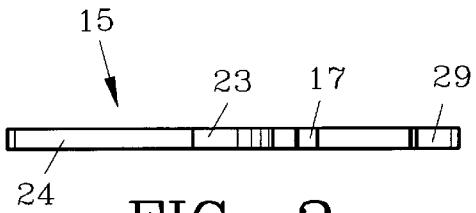
FIG. 2
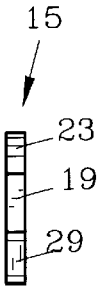
FIG. 3
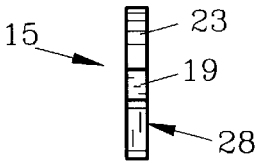
FIG. 4
FIG. 5
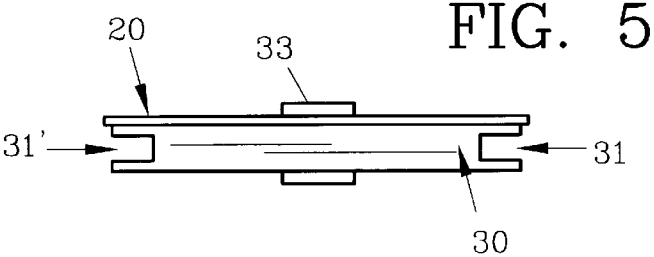
FIG. 8

GARMENT DISPLAY ASSEMBLY

FIELD OF THE INVENTION

The invention herein pertains to the retail display of garments, and particularly pertains to hanging display packaging for use with socks or the like.

DESCRIPTION OF THE PRIOR ART AND OBJECTIVES OF THE INVENTION

The manufacturing and retailing of wearing apparel has become increasingly competitive in recent years due in part to the importation of foreign goods. Hosiery and sock manufacturers have felt the increased competition more and more and have had to devise ways of increasing their market presence. It has been found that by utilizing effective retail display techniques a market advantage can be obtained. One technique or strategy most often used is to provide garment packaging which will allow consumers to easily view and handle socks, hosiery or other garment items being considered yet which will contain the goods in a neat, secure manner.

It is usual to drape a pair of socks over a hanger which in turn is suspended on a vertical panel in retail stores. It is also conventional to affix one or more pairs of socks on a hanger by the use of plastic "tacks". It is also conventional to place socks in plastic bags or wrappers with printed advertising thereon and to affix a pair of socks within a folded display panel which is then connected or joined to an abbreviated hanger.

While all of the above display methods are useful in certain circumstances they each have disadvantages. For example, some forms of display sock packages have very limited areas for printing advertising slogans, prices, trademarks and other indicia thereon. Garments which are contained within plastic bags prevent customers from "handling" such goods. Hangers, when used alone sometimes do not hold socks securely thereon and by the end of the day the merchant has to "rehang" many pairs of socks which have become dislodged therefrom.

Thus, with the problems and disadvantages associated with prior art garment display materials and methods, the present invention was conceived and one of its objectives is to provide a display assembly utilizing a hanger for positioning a display panel thereon.

It is another objective of the present invention to provide a durable plastic hanger which is designed to easily receive a display panel which prevents the display panel from inadvertently separating once assembled, and which maintains the display panel during extensive handling.

It is yet another objective of the present invention to provide a display assembly which is relatively inexpensive to manufacture and assemble and which provides a large area for printed advertising and other data.

It is still another objective of the present invention to provide a garment display assembly which will securely contain socks or other items affixed thereto during shipment or storage.

Various other objectives and advantages of the present invention will become apparent to those skilled in the art as a more detailed description is set forth below.

SUMMARY OF THE INVENTION

The aforesaid and other objectives are realized by providing a garment display assembly for socks or other items having a hanger fashioned from plastics or other inexpensive, durable materials. The hanger includes a horizontal member having teeth and at one end thereof a catch is fashioned. At the end opposite the catch a return is affixed which includes a vertical component and a hook. A folded display panel formed from cardboard or other suitable materials is then positioned between the return and longitudinal member, against the teeth and within the catch. Along the top of the display panel a flat plateau is formed containing indentations at both ends. Indentations allow for ease in assembly as the display panel is inserted between the longitudinal member and the return. A plastic tack, adhesive or the like then secures a pair of socks or other garments to the display panel. Handling during shipping, storage and delivery does not destroy the integrity of the display assembly and the socks can be easily removed from the package by simply cutting/removing the plastic tack affixed thereto.

BRIEF DESCRIPTION OF THE DRAWINGS

FIG. 1 demonstrates a left side view of the garment display assembly of the invention with the display panel removed from the hanger;

FIG. 2 provides a top view of the hanger as shown in FIG. 1;

FIG. 3 shows a front view of the hanger as seen in FIG. 1;

FIG. 4 illustrates a rear view of the hanger;

FIG. 5 shows a bottom view of the hanger;

FIG. 8 pictures a top view of the display panel and socks as shown in FIG. 6.

DETAILED DESCRIPTION OF THE PREFERRED EMBODIMENT AND OPERATION OF THE INVENTION

Figure 7:
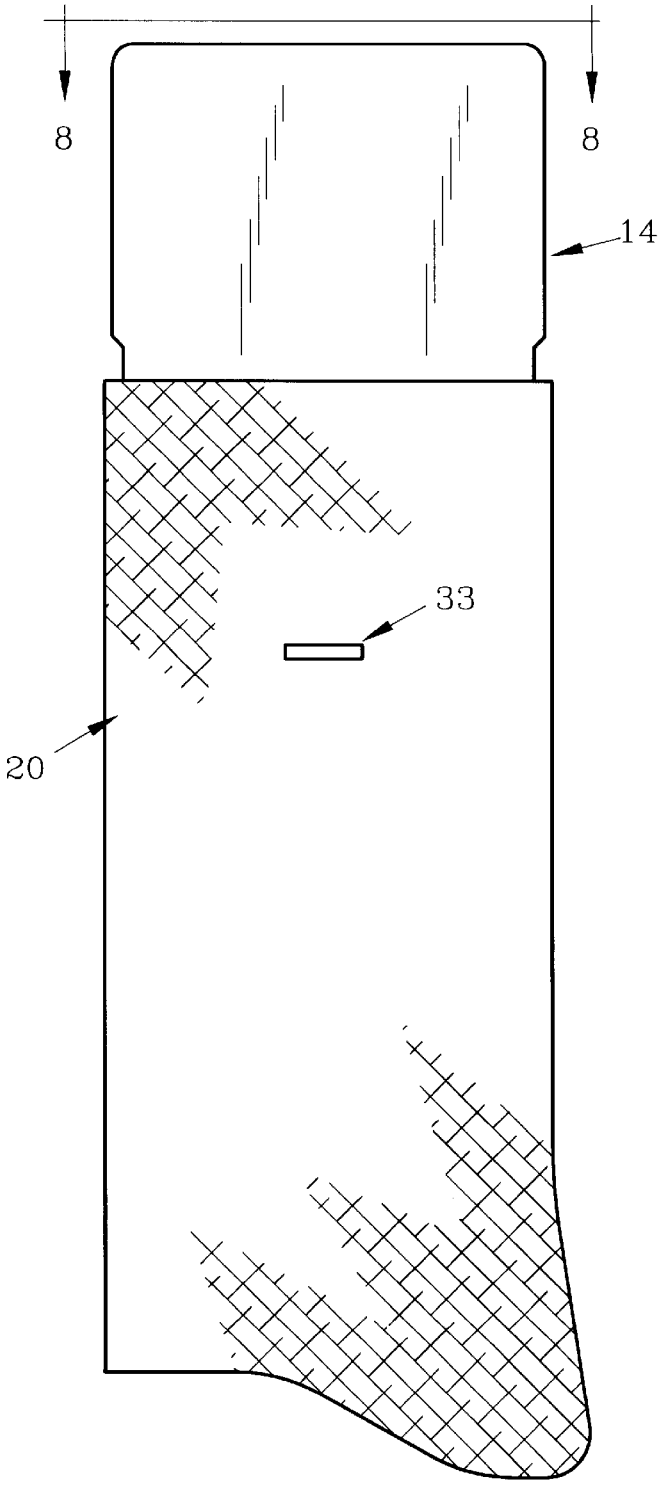
FIG. 7 depicts the garment display assembly as shown in FIG. 6 in a side view, but with the hanger removed.

For a better understanding of the invention and its use, turning now to the drawings, FIGS. 1–5 illustrate preferred molded plastic hanger 15 as removed from preferred folded display panel 14. Hanger 15 and display panel 14 form preferred garment display assembly 10 as seen in FIG. 6 with sock pair 20 affixed thereto.

Hanger 15 is molded from a durable polystyrene or other suitable plastics and includes a horizontal member 16 having a plurality of rearward facing teeth 17 and front facing tooth 18 integrally formed therewith as shown in FIG. 1. Teeth 17, 18 help maintain display panel 14 and hanger 15 securely together. Vertical component 19 is positioned over the approximate longitudinal midpoint of horizontal member 16 so display assembly 10 with sock pair 20 as shown in FIG. 6 will hang in a even, level manner on a standard board peg (not shown) or other rod. Vertical component 19 is integrally formed with hook 23 and is attached or molded at the terminal end of return 24. As further seen, return 24 is substantially parallel to horizontal member 16 and is affixed at end 28 of horizontal member 16 with catch 29 positioned at the opposite end thereof. Catch 29 and closed end 28 stabilize display panel 14 positioned therein. FIGS. 2, 3, 4 and 5 illustrate other views of hanger 15 as shown in FIG. 1 for clarity purposes to demonstrate its thickness or width. As would be understood, the right side of hanger 15 is a mirror image of the view seen in FIG. 1.

Display panel 14 is preferably formed from folded cardboard and as shown in FIG. 8 has a flat top or plateau 30. The term "display panel" does not encompass suspended garments". Plateau 30 includes indentions 31, 31'. Thus, as display panel 14 is positioned on hanger 15 as shown in FIG. 1, indentions 31' and 31 allow display panel 14 to be easily slid between horizontal member 16 and return 24, and over catch 29 for alignment of hanger 15 and display panel 14. If indentions 31, 31' are not present, mounting of panel 14 on hanger 15 would be more difficult and could cause possible tearing, bending or mutilation of display panel 14.

Figure 6:
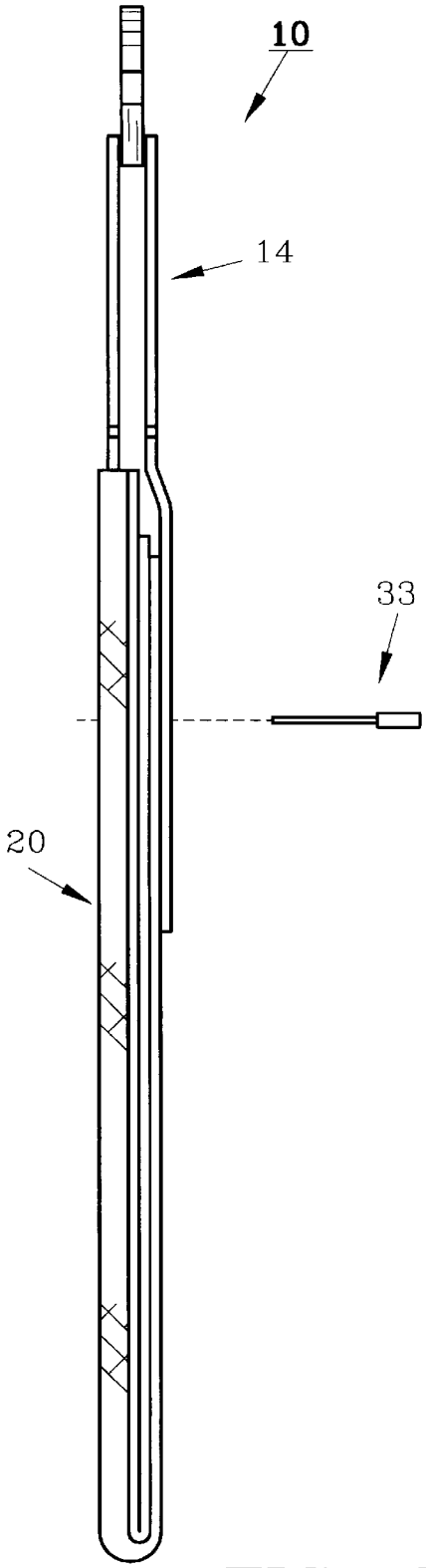
FIG. 6 features a front view of the garment display assembly with a pair of socks attached.

Once display panel 14 is positioned on hanger 15, sock pair 20 can be affixed thereto by the use of conventional plastic tack 33 as shown in FIG. 6. Plastic tack 33 is inserted through sock pair 20 and both sides of panel 14 by the use of a commercial pneumatic tack gun or the like to penetrate and securely bind sock pair 20 to display panel 14. In FIG. 7, sock pair 20 is shown affixed to display panel 14 but without hanger 15. A top view of display 14 and sock pair 20 is shown in FIG. 8 with tack 33 in place to illustrate the positioning thereof.

The present invention has been found to be a durable, inexpensive manner of displaying a pair of socks although other garment items, handkerchiefs and the like could likewise be packaged. Of course, the illustrations and examples provided herein are for explanatory purposes and are not intended to limit the scope of the appended claims.

I claim:

1. An assembly for displaying garments comprising:

a) a hanger, said hanger comprising a vertical component, a horizontal member, a return, said return attached to said horizontal member at one end thereof, said vertical component joined to said return whereby the horizontal member is supported proximate the middle thereof;

b) a catch, said catch mounted on said horizontal member at the other end thereof to form an opening between said catch and said return; and c) a display panel, said panel positioned on said horizontal member to straddle the same whereby a display panel can be placed through said opening onto said horizontal member and a garment can be attached to said display panel and be suspended by said hanger.

2. The assembly of claim 1 further comprising a plurality of teeth, said teeth positioned on said horizontal member.

3. The assembly of claim 1 wherein said vertical component comprises a hook.

4. The assembly of claim 1 wherein said hanger is formed from plastic.

5. The assembly of claim 1 wherein said display panel is folded.

6. The assembly of claim 5 wherein said display panel is formed from cardboard.

7. The assembly of claim 5 wherein said display panel comprises a flat plateau.

8. The assembly of claim 7 wherein said plateau defines an indentation, said indentation surrounding said catch.

9. The assembly of claim 7 wherein said display panel comprises a front and a back, said front and said back attached to opposite sides of said plateau for affixing garments thereto.

10. An assembly for displaying garments such as pairs of socks comprising:

a) a hanger, said hanger comprising a horizontal member, a return member, said return member joined to said horizontal member at one end thereof, a vertical component, said vertical component joined to said return member, a catch, said catch attached to the other end of said horizontal member to form an opening between said return and said catch;

b) a folded display panel, said display panel positioned on said horizontal member in said opening between said catch and said return; and c) a garment, said garment affixed to said display panel.

11. The assembly of claim 8 wherein said display panel comprises a flat plateau, said plateau straddling said horizontal member.

12. The assembly of claim 8 wherein said longitudinal member comprises teeth.

13. The assembly of claim 8 wherein said vertical component comprises a hook.

14. The assembly of claim 10 wherein said garment comprises a pair of socks.

* * * * *